US007129448B2

(12) United States Patent
Matsunaga et al.

(10) Patent No.: US 7,129,448 B2
(45) Date of Patent: Oct. 31, 2006

(54) HEATING APPARATUS FUSING APPARATUS AND IMAGE FORMING APPARATUS

(75) Inventors: Takashi Matsunaga, Kumamoto (JP); Masayuki Isayama, Kumamoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/080,431

(22) Filed: Mar. 16, 2005

(65) Prior Publication Data

US 2005/0205555 A1 Sep. 22, 2005

(30) Foreign Application Priority Data

Mar. 17, 2004 (JP) ..... 2004-076235

(51) Int. Cl.
*H05B 6/14* (2006.01)
*G03G 15/20* (2006.01)
*H05B 6/40* (2006.01)

(52) U.S. Cl. ..... 219/619; 219/670; 219/672; 399/328; 399/330

(58) Field of Classification Search ..... 219/619, 219/649, 652, 647, 670–676; 399/328–338
See application file for complete search history.

(56) References Cited

U.S. PATENT DOCUMENTS 3,790,736 A * 2/1974 Matsumura et al. ..... 219/619
5,822,669 A * 10/1998 Okabayashi et al. ..... 399/330
6,097,926 A * 8/2000 Takagi et al. ..... 399/328
6,336,027 B1 * 1/2002 Sakai et al. ..... 399/328
6,495,811 B1 * 12/2002 Nitsche et al. ..... 219/619
6,584,298 B1 * 6/2003 Omoto et al. ..... 399/330
2002/0007752 A1 * 1/2002 Sakagami ..... 101/487
2002/0048472 A1 * 4/2002 Samei ..... 399/328

FOREIGN PATENT DOCUMENTS

JP 9-26719 1/1997

OTHER PUBLICATIONS

English Language Abstract of JP 9-26719.

* cited by examiner

*Primary Examiner*—Philip H. Leung
(74) *Attorney, Agent, or Firm*—Greenblum & Bernstein, P.L.C.

(57) ABSTRACT

A heat apparatus for an electromagnetic induction heating system comprises a heat roller that comprises magnetic and conductive material. The heating apparatus also comprises a magnetic excitation coil that is positioned around a portion of the periphery of the heat roller. The magnetic excitation coil is configured to generate a magnetic field that extends to the heat roller, to generate an eddy current within the heat roller, and to generate Joule heat within the heat roller. The magnetic excitation coil is configured to generate a smaller magnetic field at the center area of the heat roller than at the side areas of the heat roller.

17 Claims, 12 Drawing Sheets

HEATING APPARATUS FUSING APPARATUS AND IMAGE FORMING APPARATUS

BACKGROUND OF THE INVENTION

1. Field of the Invention

The present invention relates to a heating apparatus for an electromagnetic induction heating system. In particular, the present invention relates to a fusing apparatus using the heating apparatus and to an image forming apparatuses such as a copying machine, a facsimile or a printer that uses an electrostatic recording system.

2. Description of Related Art

Normally, fixing devices that use an electromagnetic induction heating system as a heating source changed to, for example, a halogen lamp, have come to be widely used in order to save energy and increase speed of fixing devices used for image forming apparatuses such as printers and copying machines. In related fixing devices that use an electromagnetic induction heating system, a magnetic field generated by a magnetic field generator acts on a heat generator with this eddy current causing this heat generator to generate Joule heat. As an example, this heating apparatus can be used as a fixing device of an image forming apparatus that heats images not yet fixed which are formed on a recording medium (such as transfer or an OHP sheet) by applying an image forming technique.

In order to shorten the heating time, fixing devices, which used the heating apparatus applying the electromagnetic induction heating system, utilized a thin conductive film layer with a small heat capacity. This film would generate an eddy current in the magnetic field of the magnetic excitation coil and thereby generate heat. However, when comparing the center and the end of the film in the lengthwise direction of the fixing belt, heat is lost to the bearing that supports the film at the end and in addition because the heat radiating surface area of the opening is large, the amount of heat radiating along the end becomes larger. Because of this, the temperature at the end of the fixing belt reduced compared to the temperature at the center of the fixing belt thereby making it impossible to supply enough heat energy to the recording material and the toner on the recording material at the end leading to a problem of offset that resulted in incomplete toner fixing at the end. Conventionally, in order to improve the phenomenon of temperature reductions at the end of these fixing belts, a composition was used in which the distance between the magnetic excitation coil and the heat generator was varied (for example Related Art 1).

[Related Art 1] Japanese Patent Publication H9-26719

The length of the magnetic path in the composition that varies the distance between the magnetic excitation coil and the heat generator disclosed in Related Art 1 above becomes longer, increasing the magnetic resistance and thereby increasing the electric power supplied to the heat generator. Because the upper limit of the electric power that can be supplied from a power outlet to household appliances and office equipment (to an image forming apparatus in this invention) is restricted by laws and regulations, there are also restrictions on the amount of electric power that can be supplied to a magnetic excitation coil used for electromagnetic induction heating. Consequently, there are problems of the portion of the amount of electric power that effectively increased the magnetic resistance becoming a loss thereby making it impossible to supply enough electric power to a heat generator resulting in the time the temperature of the heat generator rises becoming slower.

SUMMARY OF THE INVENTION

The present invention takes the problems mentioned above into consideration and provides a heating apparatus, a fusing apparatus and an image forming apparatus that do not make the magnetic resistance worse and can accordingly ensure the amount of electric power supplied to a heat generator as well as make the uniformly distribute the temperature in the lengthwise direction of the heating roller without slowing down the rise time of the heat generator.

In order to solve these problems, the present invention was comprised to include a heat generating material that has magnetism and conductivity and a magnetic excitation coil that is arranged opposite the heat generating material and makes use of electromagnetic induction to heat the generating material. In this composition, the strength of the magnetic field generating from the magnetic excitation coil at one portion between both ends was made to be smaller than both ends of the magnetic excitation coil.

Because of this, the magnetic field that heats the heat generator in the lengthwise direction at the end of the magnetic excitation coil can make the magnetic field that heats the heat generator in the lengthwise direction at the center smaller than the magnetic field that heats the heat generator in the lengthwise direction at both ends as well as achieve uniformity in the temperature distribution in the entire lengthwise direction.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 3(*b*) is a side view showing a magnetic excitation coil of an induction heater in the fixing device of FIG. 2;

FIG. 4(*b*) is a cross-section along line B—B of FIG. 3;

FIG. 4(*c*) is a cross-section along line C—C of FIG. 3;

FIG. 5(*b*) is a graph showing the heat generation amount on a fixing roller that corresponds to the cross-section of (a);

FIG. 6(*b*) is a graph showing the heat generation amount on a fixing roller that corresponds to the cross-section of (a);

FIG. 8(*b*) is a cross-section of plane B of the magnetic excitation coil of FIG. 5 related to the second embodiment of the present invention;

FIG. 8(*c*) is a cross-section of plane C of the magnetic excitation coil of FIG. 5 related to the second embodiment of the present invention;

FIG. 11(*b*) is a cross-section of plane B of (d);

FIG. 11(*c*) is a cross-section of plane C of (d);

FIG. 11(*d*) is a modified example of another cross-section shape related to the first embodiment of the present invention;

DETAILED DESCRIPTION OF PREFERRED EMBODIMENTS

The embodiments of the present invention are explained in the following, in reference to the above-described drawings.

First Embodiment

Figure 1:
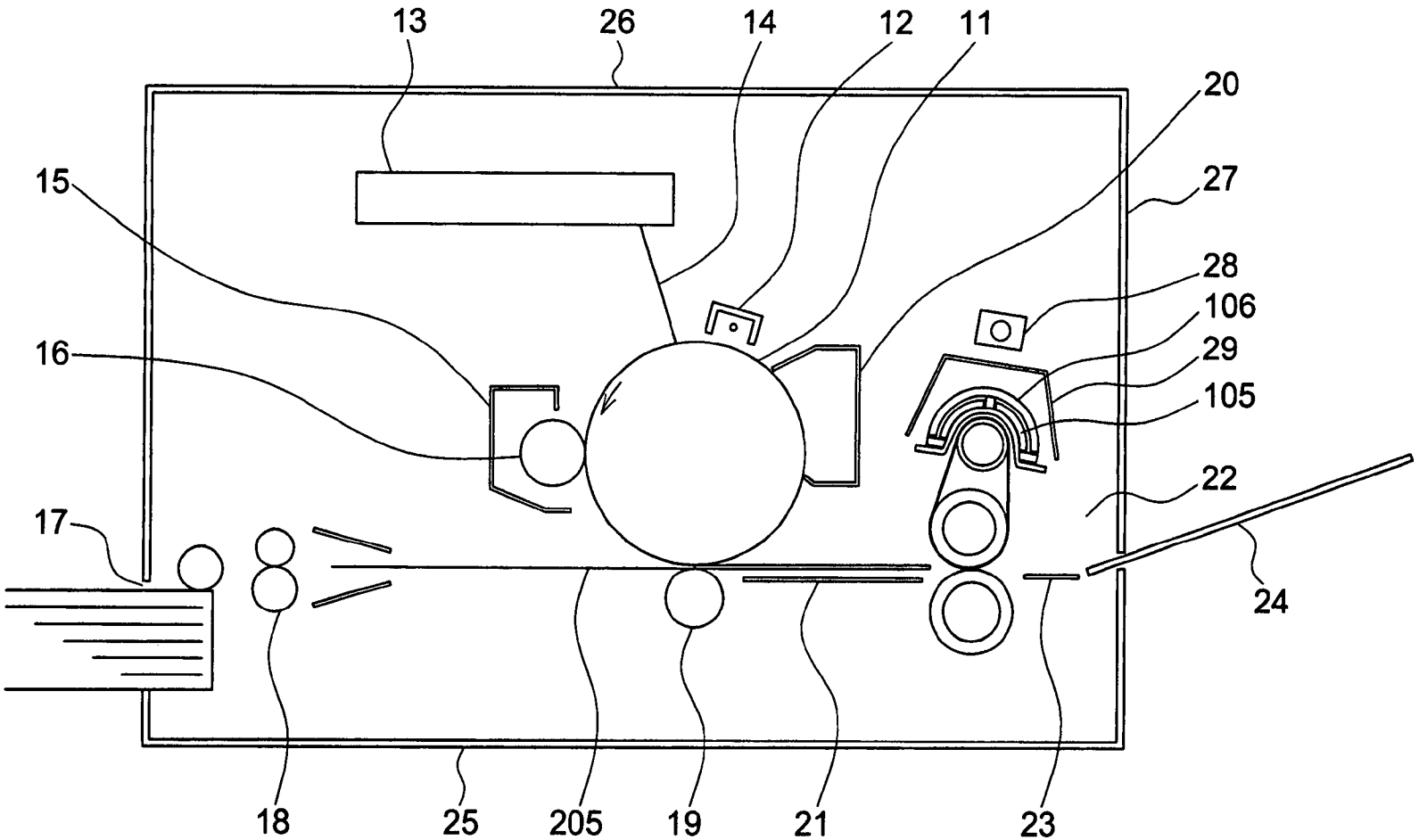
FIG. 1 is a cross-section showing an image forming apparatus that uses the image heating apparatus related to the first embodiment of the present invention as a fixing device.

FIG. 1 is an example of a cross-section showing an image forming apparatus that uses the image heating apparatus related to the first embodiment of the present invention as a fixing device. In FIG. 1, 11 is an electrophotographic photosensitive material (hereinafter referred to as photosensitive drum). The surface of the photosensitive drum 11 is uniformly charged by a corona assembly 12 to a negative dark electric potential V0 while the drum is rotated at a fixed peripheral speed in the direction of the arrow. In the figure, 13 is a beam scanner. The beam scanner 13 outputs a laser beam 14 modulated in correspondence with a time sequenced electric digital picture element signal of an image device input from a host device such as an image reading device or a computer (not shown in the figure). The surface of the charged photosensitive drum 11 is scanned and exposed by this laser beam 14. This action reduces the electric potential absolute value to bright electric potential VL and then an electrostatic latent image is formed on the exposed portion of the photosensitive drum 11. This latent image is developed and made apparent by negatively charged toner of a developing assembly 15.

The developing assembly 15 includes a developing roller 16 that rotates. The developing roller 16 is arranged opposite the photosensitive drum 11 and a thin layer of toner is formed on the outer peripheral surface. The electric potential absolute value on the developing roller 16 is smaller than the dark electric potential V0 of the photosensitive drum 11 and a developing bias larger than the bright electric potential VL is applied to the developing roller 16. Due to this action, the toner on the developing roller 16 is transferred to the photosensitive drum 11 at the bright electric potential VL only and the latent image is then made apparent.

In contrast, the recording medium 205 is fed one sheet at-a-time from a pickup assembly 17 and then sent to the photosensitive drum 11 and a nip assembly of a transfer roller 19 through a registration roller 18 at a suitable timing synchronized with the rotation of the photosensitive drum 11. Thereafter, the toner image on the photosensitive drum 11 is sequentially transferred to the recording medium 205 by the transfer roller 19 onto which a transfer bias is applied. Any material, such as leftover transfer toner, remaining on the surface of the photosensitive drum 11 after the recording medium 205 is separated is removed by a cleaning device 200 and then repeatedly supplied to the subsequent image formation.

In the figure, 21 is a fixing guide. Movement towards the fixing device 22 of the recording material 205 after a transfer is guided by the fixing guide 21. The recording material 205 is fed to the fixing device 22 after being separated from the photosensitive drum 11 and the toner image transferred onto the recording material 205 by this is fixed. In the figure, 23 is a delivery guide. The recording material 205 that passes through the fixing device 22 is guided outside the apparatus by this delivery guide 23. The fixing guide 21 and the delivery guide 23 are comprised by a resin such as ABS. In addition, the fixing guide 21 and the delivery guide 23 can also be comprised by a non-magnetic metal such as aluminum. The recording material 205 is guided to a delivery tray 24 after the timer image is fixed.

In the figure, 25 is the bottom plate of the apparatus main body, 26 is the top plate of the apparatus main body, and 27 is chassis of the main body. These members are integrated and maintain the strength of the entire apparatus. These members have a base material of steel (magnetic material) and are comprised by zinc-plated material.

In the figure, 28 is a cooling fan. This cooling fan 28 generates air currents inside the apparatus. In the figure, 29 is a coil cover that functions as a cover member and includes a non-magnetic metal such as aluminum. This coil cover 29 is comprised so as to cover the back surface of the magnetic excitation coil 105 and an arch core 106.

Next, the fixing device that functions as the heating apparatus of the first embodiment will be described in detail.

Figure 2:
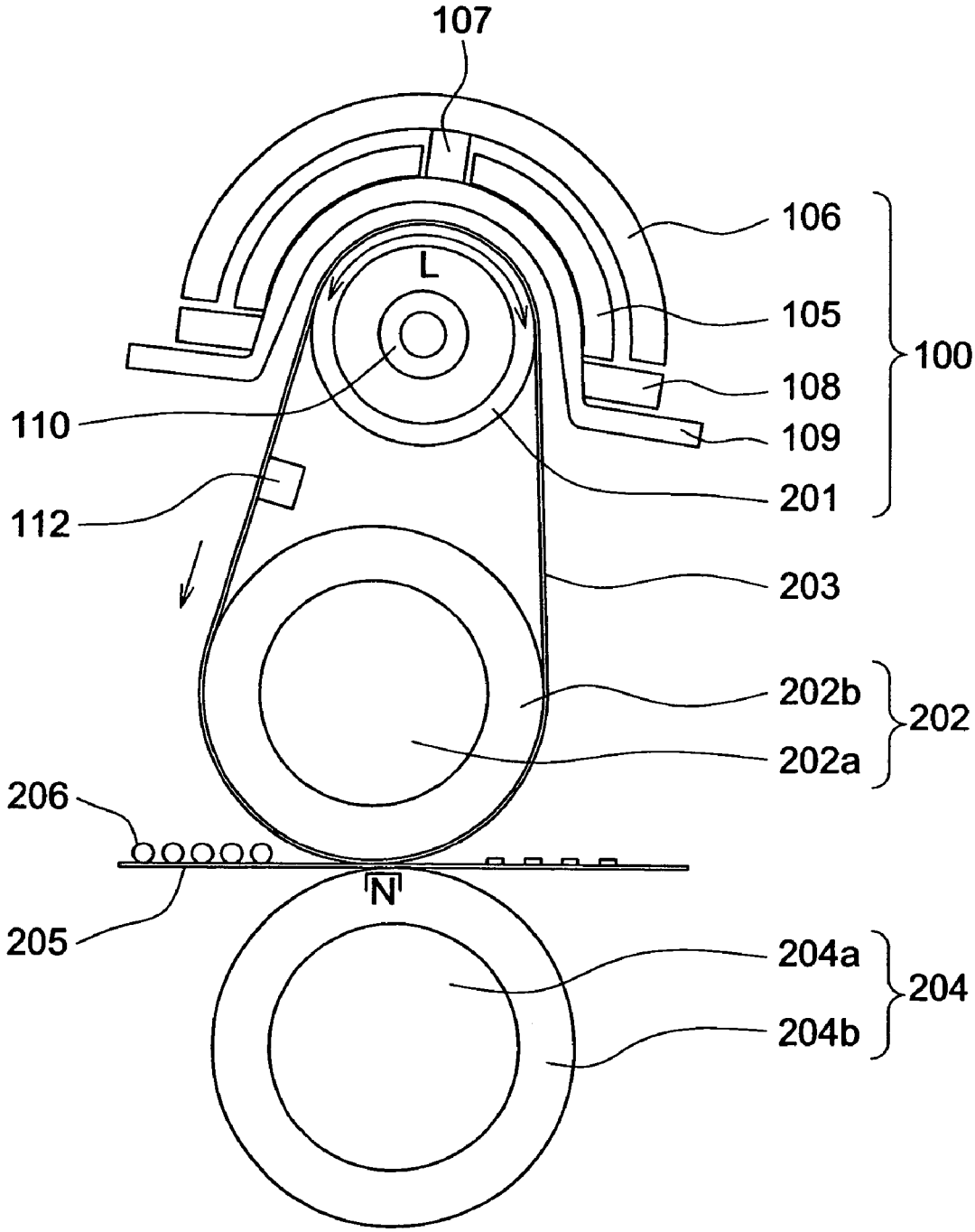
FIG. 2 is a descriptive drawing that shows the fixing device related to the first embodiment of the present invention.
Figure 3A:
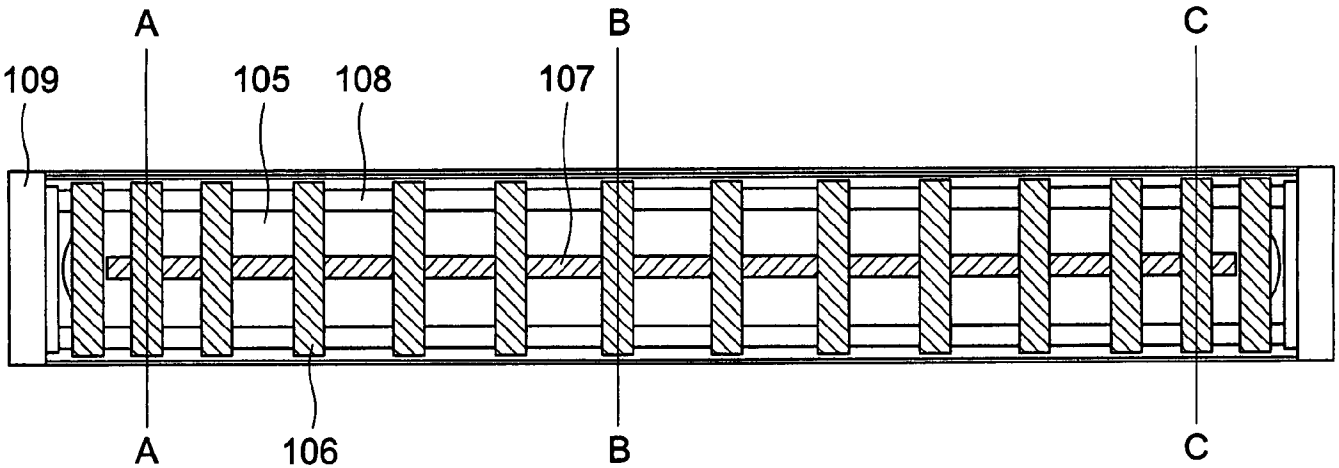
FIG. 3(*a*) is a top plan view showing a magnetic excitation coil of an induction heater in the fixing device of FIG. 2.
Figure 3B:
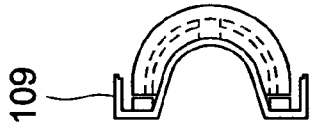
Figure 4A:
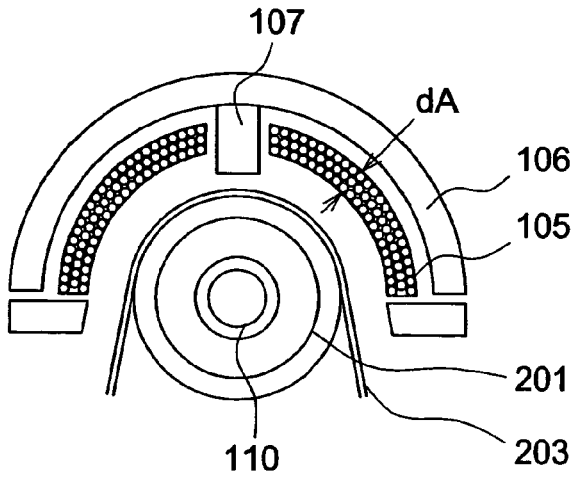
FIG. 4(*a*) is a cross-section along line A—A of FIG. 3.
Figure 4B:
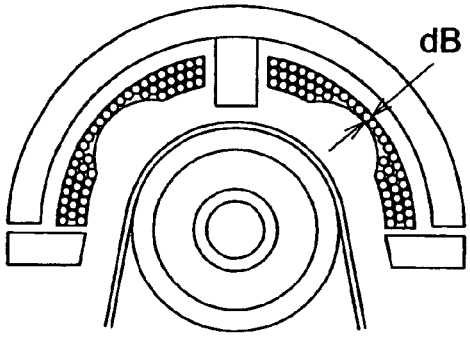
Figure 4C:
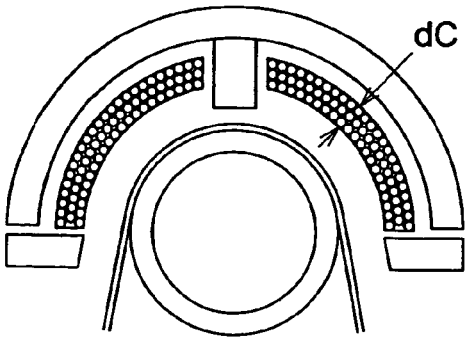
Figure 5A:
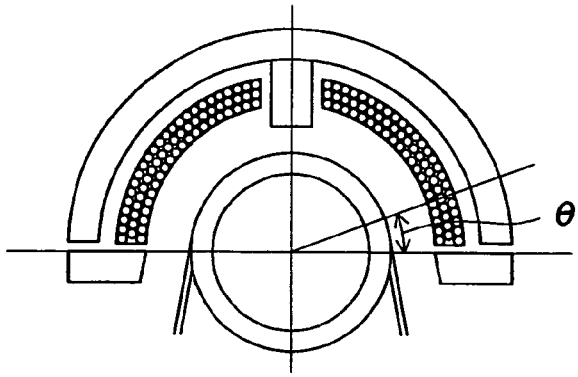
FIG. 5(*a*) is a cross-section of uniform coil thickness of the heating apparatus related to the first embodiment of the present invention.
Figure 5B:
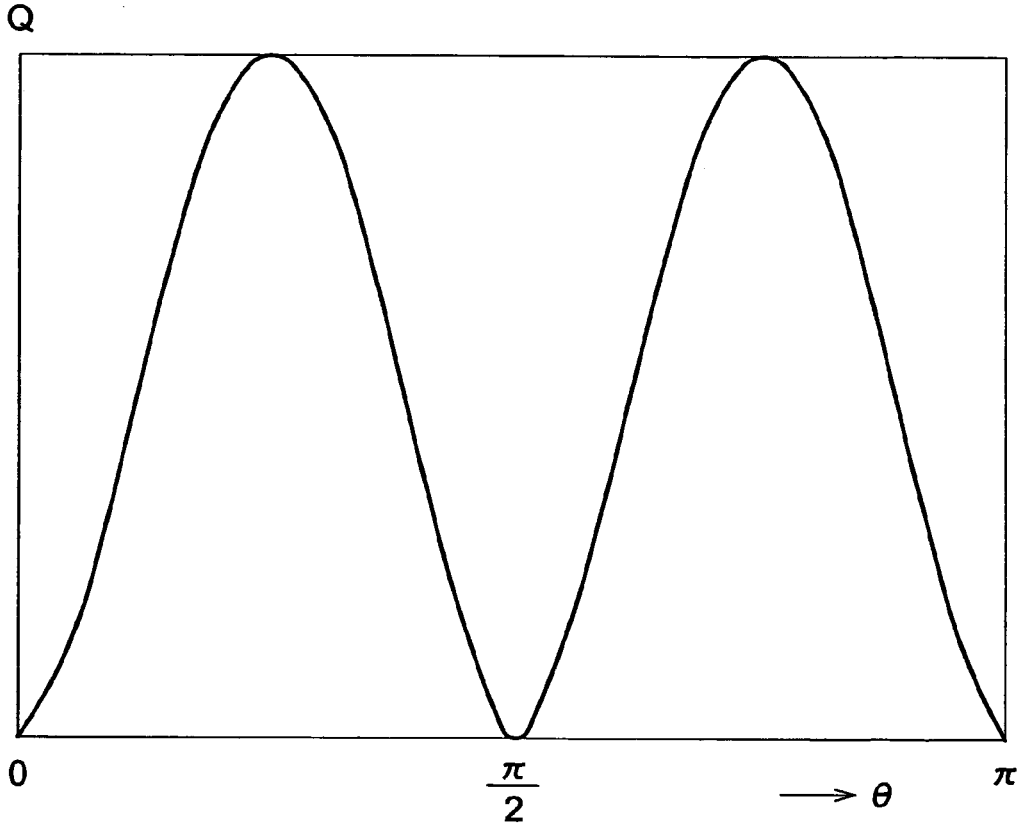
Figure 6A:
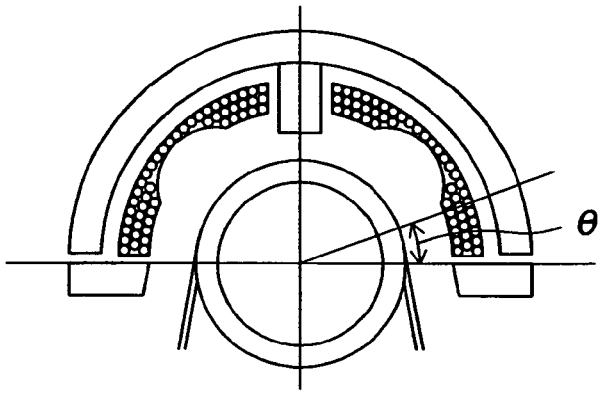
FIG. 6(*a*) is a heating apparatus cross-section with a modified coil thickness related to the first embodiment of the present invention.
Figure 6B:
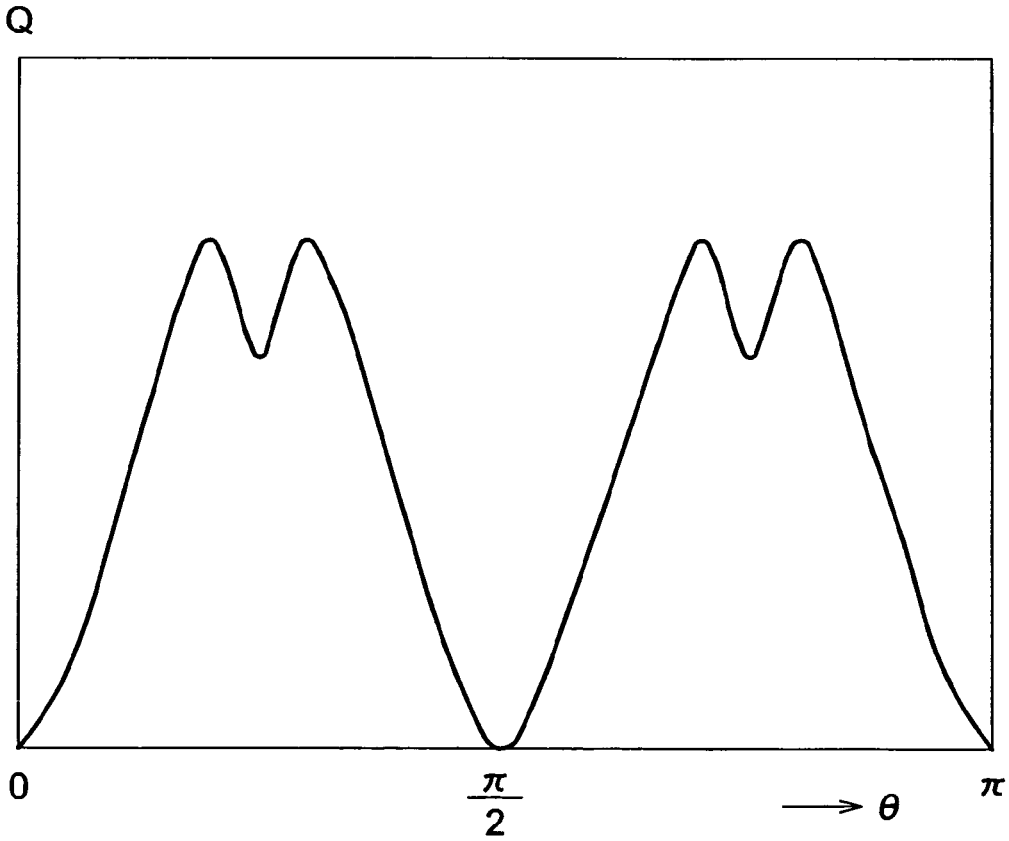

FIG. 2 is a descriptive drawing that shows the fixing device related to the first embodiment of the present invention. FIG. 3(*a*) is a top plan view showing the magnetic excitation coil of the induction heater in the fixing device of FIG. 2, and FIG. 3(*b*) is a side view showing the magnetic excitation coil of the induction heater in the fixing device of FIG. 2. FIGS. 4(*a*), (*b*), and (*c*) are cross-sections along line A—A, B—B, and C—C of FIG. 3, respectively. FIG. 5(*a*) is a cross-section of uniform coil thickness of the heating apparatus related to the first embodiment of the present invention and FIG. 5(*b*) is a graph showing the heat generation amount on the fixing roller that corresponds to the cross-section of (a). FIG. 6(*a*) is a heating apparatus cross-section with a modified coil thickness related to the first embodiment of the present invention and FIG. 6(*b*) is a graph showing the heat generation amount on a fixing roller that corresponds to the cross-section of (a).

The fixing device shown in FIG. 2 is an electromagnetic induction heating system heating apparatus used in an image forming apparatus. This fixing device includes a heating roller 201 (first body of rotation) that is heated along the outer peripheral surface by electromagnetic induction of an induction heater 100, an endless heat generation belt 203 (second body of rotation) that is tensioned on the heating roller 201 and the fixing roller 202 and heated by electromagnetic induction along with rotating in the direction of arrow A by rotation of the fixing roller 202, a pressure roller 204 (pressure member) that makes contact with the heat generation belt 203 to form a nip assembly and is pressure welded to the fixing roller 202 along with rotating in the direction following the heat generation belt 203, and an opposing core 110 placed between the heat generation belt 203 and the heating roller 201 opposite to the magnetic excitation coil 105. A strong magnetic material such as ferrite or permalloy can be used for the material of the opposing core 110.

Here, as an example, the heating roller 201 is comprised by Fe, Ni and a hollow, cylindrical strongly magnetic metal material of an Fe, Ni alloy (such as SUS). The outer diameter is, for example, 20 mm and the skin thickness 0.1 mm with a low temperature capacity and slow temperature rise.

The fixing roller 202 includes, for example, a metallic core 202*a* such as SUS and an elastic member 202*b* that forms a heat resistant silicon rubber into a solid or foam shape and covers the metallic core 202*a*. In order to form a contact portion with a specified width between the pressure roller 204 by a pressing force from the pressure roller 204, the outer diameter is made larger than the heating roller 201 by approximately 30 mm. The thickness of the elastic member 202*b* is approximately 3 to 8 mm, and the rigidity 15 to 50° (Asker C).

Because this type of composition makes the heat capacity of the heating roller 201 smaller than the heat capacity of the fixing roller 202, the heating roller 201 is quickly heated and the warm-up time reduced.

The heat generation belt 203 that is tensioned between the heating roller 201 and the fixing roller 202 is heated by the induction heater 100 arranged on the outer peripheral surface of the heating roller 201 and also undergoes thermal conduction heating at contact position L with the heated heating roller 201. The inner surface of the heat generation belt 203 is continuously heated by the rotation of the heat generation belt 203 that follows the rotation of the fixing roller 202 rotated by a drive system (not shown in the figure). As a result, heating occurs along the entire belt.

The heat generation belt 203 is comprised by an endless belt with a diameter of 50 mm and a thickness of 50 μm formed with a conductive layer that has a base material in which silver particles are dispersed into a polyimide resin with a glass transition point of 360° C. The conductive layer can also be comprised by 2 to 3 laminated silver layers 10 μm thick. Furthermore, a 5 μm thick release layer (not shown in the figure) that contains fluoride resin can also cover the surface of the heat generation belt 203 in order to provide releasibility. The glass transition point of the base material of the heat generation belt 203 it preferably in a range of 200 (° C.) to 500 (° C.). A single or mixed resin or rubber with good releasibility such as PTFE, PFA, FEP, silicon rubber, or fluorine rubber can be used for the release layer of the surface of the heat generation belt 203.

Other than the polyimide resin mentioned above, a resin that has heat resistance such as fluorine resin, an electroformed thin nickel plating, and a metal such as stainless steel plating can also be used for the base material of the heat generation belt 203. For example, the heat generation belt 203 can have copper plating with a thickness of 10 μm or a nickel electroformed belt with a thickness of 30 to 60 μm on the surface of 40 μm thick SUS 430 (magnetic) or SUS 304 (non-magnetic).

Although the heat generation belt 203 can maintain releasibility only when used as an image heater for heat fixing of monochrome images, when the heat generation belt 203 is sued as an image heater for heat fixing of color images, it is preferable to form a rubber layer to provide elasticity.

The pressure roller 204 is comprised by, or example, a metallic core 204*a* that contains a cylindrical metal with high heat conductivity such as SUS or A1 and an elastic member 204*b* with high heat resistance and toner releasibility provided on the surface of this metallic core 204*a*.

This type of pressure roller 204 makes contact with the heat generation belt 203, presses the fixing roller 202, and forms fixing nip assembly N. In this embodiment, the outer diameter at the outlet of the fixing nip assembly N is approximately 30 mm the same as the fixing roller 202 in order to increase the peeling action of the toner. The skin thickness is approximately 2 to 5 mm thinner than the fixing roller 202 and the rigidity is approximately 20 to 60° (Asker C) harder than the fixing roller 202.

As shown in FIG. 2, the induction heater 100 that heats the heating roller 201 by electromagnetic induction has a magnetic excitation coil 105 that is a magnetic field generator and a coil guide 109. Here, the coil guide 109 is a semicircular arch shape formed close to the outer peripheral surface of the heating roller 201 and is comprised to work as a heat insulator between the heating roller 201 and the magnetic excitation coil 105 as well as to function as a member that secures the magnetic excitation coil 105 and arch core 106, center core 107, and the side core 108. In other words, the coil guide 109 blocks heat radiating to the adjacent magnetic excitation coil 105 making it possible to control the heat generation of the magnetic excitation coil 105 in order that the temperature of the heating roller portion reaches, for example, a fixing temperature of 180° C.

The magnetic excitation coil 105 is formed and wound combining 1 to 10 Litz wire bundles which have wires with a wire strand diameter f of 0.05 to 0.2. The magnetic excitation coil 105 is secured to this coil guide 109. The outer diameter of the Litz wire uses a combination of wire bundles with a maximum outer diameter of 2 mm. the coil thickness can be 2 mm. In order to have correspondence with a thinner coil thickness, the number of Litz wires of one Litz wire bundle can be from 10 to 40. The outer diameter of the Litz wire can be calculated according to JIS C005 (Formula 1).

$$D=1.154\times d\times\sqrt{n} \qquad \text{[Formula 1]}$$

(In this formula D is the outer diameter of the Litz wire, d is the outer diameter of wire strand of the Litz wire, and n is the number of wire strands.)

Therefore, the thick part of the magnetic excitation coil and the thin part of the magnetic excitation coil can be wound matching the space of the wire winding jig by combining multiple Litz wire bundles and simultaneously winding them. In addition, the electrical resistance increases due to high-frequency AC current with a wire strand diameter that has a wire diameter larger than f 0.2.

The length of the magnetic excitation coil 105 is the same length as the region adjacent to the heat generation belt 203 and the heating roller 201 in the direction of axial rotation of the heating roller 201.

According to this, the region of the heating roller 201 that undergoes electromagnetic induction heating by the induction heater 100 is at the maximum and the time the surface of the heating roller 201 that is generating heat and the heat generation belt 203 are adjacent is also at the maximum. Because of this, the heat transfer efficiency increases.

In addition, the magnetic excitation coil 105 is connected to a drive power supply (not shown in the figure) whose frequency is varied by an oscillator circuit.

The outside of the magnetic excitation coil 105 is comprised by the arch core 106 formed in an arch shape covering the back of the magnetic excitation coil 105, the center core 107 arranged at the center of the magnetic excitation coil 105, and the side core 108 arranged at the end of the winding bundle of the magnetic excitation coil 105. A strong magnetic material such as ferrite or permalloy can be used for the core material.

The center core 107 and the side core 108 comprise a magnetic path together with the arch core 106. Because of this, a good part of the magnetic flux generated by the magnetic excitation coil 105 on the outside of the heat generation belt 203 passes through these three types of cores and magnetic flux leakage to the outside of the core is reduced. All three of these types of cores are not required. One core, a combination, or no cores can be used.

The center core 107 and the side core 108 can be integrated with the arch core 106 and a combination of materials can be used.

A high-frequency AC current of 10 kHz to 1 MHz (more preferably a high-frequency AC current of 20 kHz to 800 kHz) is supplied from the drive power supply (not shown in the figure) to the magnetic excitation coil 105. This AC current supply generates an alternating magnetic field between the magnetic excitation coil 105, the arch core 106, the center core 107 and the side core 108, and the opposing core 110. This alternating magnetic field at the contact region L between the heating roller 201 and the heat generation belt 203 as well as close to this acts on the heating roller 201 and an excess current flows in a direction that interferes with variations in the magnetic field mentioned above within these areas.

This excess current generates Joule heat in proportion to the resistance of the heating roller 201 and mostly the contact region between the heating roller 201 and the heat generation belt 203 as well as close to this undergo electromagnetic induction heating and are heated.

The inside surface temperature of the belt of the heat generation belt 203 heated in this manner is detected by a temperature detector 112 that includes a temperature-sensitive element with high heat response such as a thermistor at the inlet of the fixing nip assembly N.

This eliminates the temperature detector 112 scratching the surface of the heat generation belt 203. Consequently, the fixing performance is continuously ensured along with the temperature just before entering the fixing nip assembly N of the heat generation belt 203 being detected. The temperature of the heat generation belt 203 is stably maintained at, for example, 170° C. by controlling the electrical power introduced to the induction heater 100 based on the signals output which are based on this temperature information.

When a non-fixing toner 206, formed on the recording medium 205, is introduced into the fixing nip assembly N in an image forming assembly (not shown in the figure) installed above the fixing device, it is fed into the fixing nip assembly N in a state in which the difference between the front surface temperature and the rear surface temperature of the heat generation belt 203 heated by the induction heater 100 is smaller. Because of this, the belt surface temperature becomes excessively high with respect to the set temperature. In other words, it becomes possible to suppress overshoot and control the temperature at a stable level.

Next, the composition of the heating apparatus related to the first embodiment will be described in detail.

As shown in FIG. 4, the magnetic excitation coil 105 is comprised such that the coil thickness of the center assembly of the coil width becomes thinner than the end towards the center assembly with respect to the direction of the axis of rotation of the heating roller 201.

The Joule heat generated in the heating roller 201 and the heat generation belt 203 by the magnetic field generated by the magnetic excitation coil 105 changes depending on the thickness of the magnetic excitation coil 105 with respect to the direction of the axis of rotation of the heating roller 201.

FIG. 5(*b*) is a graph showing the heat generation amount on a heating belt of a coil of the magnetic excitation coil 105 with a uniform thickness. FIG. 6(*b*) is a graph showing the heat generation amount on a heating belt when the magnetic excitation coil thickness changes. When the thickness of the magnetic excitation coil 105 is thin, the magnetic field supplied to the heat generator acts in a direction that becomes weaker. Because of this, if the thickness becomes thinner, the heat generation amount of the heat generator will reduce.

In contrast, the heat radiation amount in the direction of the axis of rotation of the heating roller 201 becomes larger from the end towards the center. This is due to the fact that the heat radiation area becomes larger at the end of the heating roller 201 compared to the center. In order to obtain a uniform temperature distribution in the fixing nip assembly N, the heat generation amount at the end in the heating roller 201 must increase.

In this embodiment, the thickness d at the center of the coil winding width of the magnetic excitation coil 105 with respect to the direction of the axis of rotation of the heating roller 201 is comprised to become larger from the center towards the end. In other words, if the thickness of the center of the coil winding width of the magnetic excitation coil 105 at the center is dB and the winding wire thickness of the magnetic excitation coil 105 at the end is dA, dC, a relationship of dB<dA, dB<dC will be established.

The coil winding width center is preferably an angle of approximately 45°+/−15° and the center in the lengthwise direction of the magnetic excitation coil 105 is wound thinly with the thickness of the angle being approximately 45°+/−15° and the thickness of the magnetic excitation coil 105 with an angle of approximately 45°+/−15° at the end is wound thickly.

In this manner, the amount of eddy current occurring on the surface of the heating roller 201 at the end becomes larger compared to the amount of eddy current occurring at the center. The heat generation amount at the end can be increased and the temperature distribution in the fixing nip assembly N can be made uniform.

Second Embodiment

Figure 7:
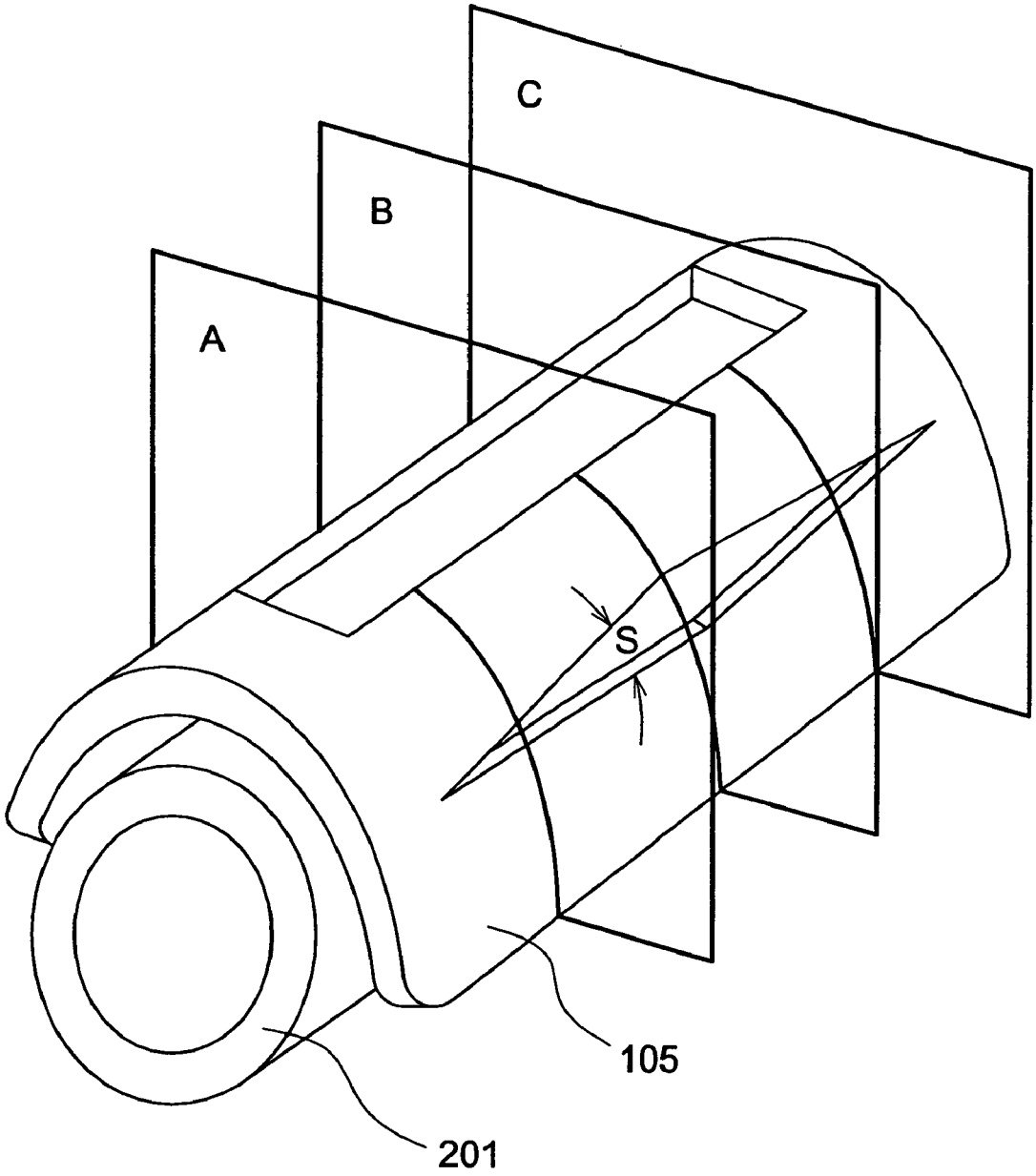
FIG. 7 is a perspective view showing a magnetic excitation coil of an induction heater related to the second embodiment of the present invention.
Figure 8A:
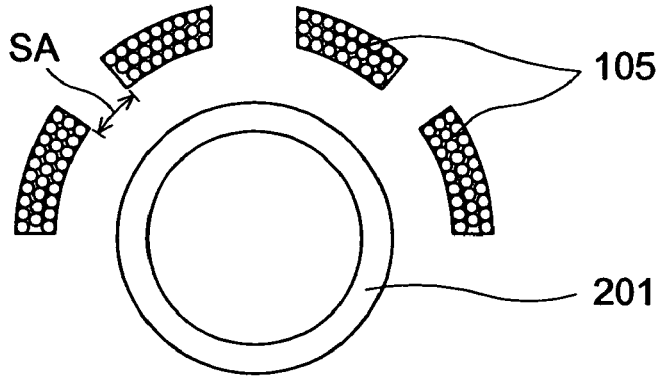
FIG. 8(*a*) is a cross-section of plane A of the magnetic excitation coil of FIG. 5 related to the second embodiment of the present invention.
Figure 8B:
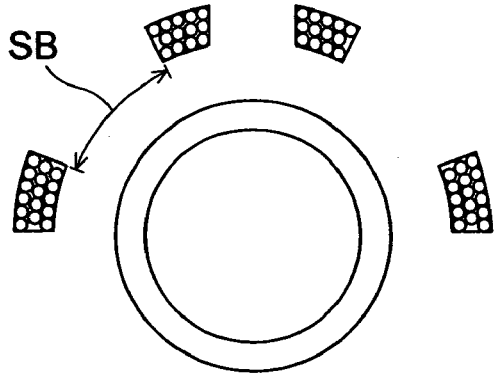
Figure 8C:
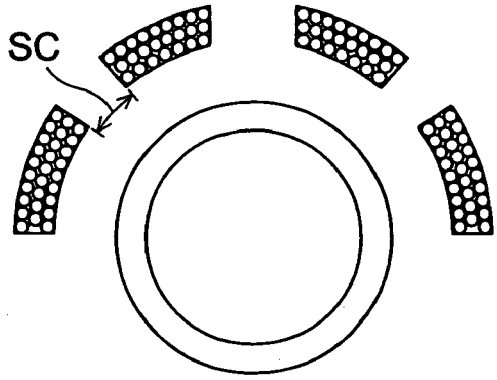
Figure 9A:
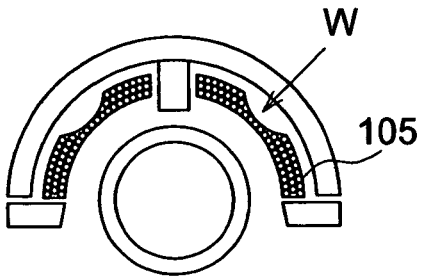
FIG. 9 shows a modified example of a coil shape related to the second embodiment of the present invention.
Figure 9B:
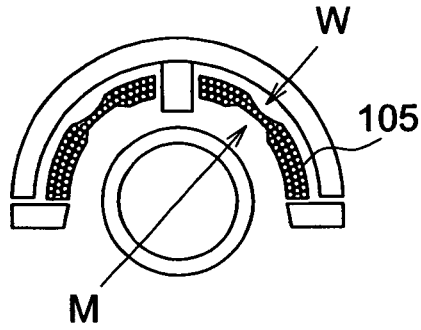
Figure 9C:
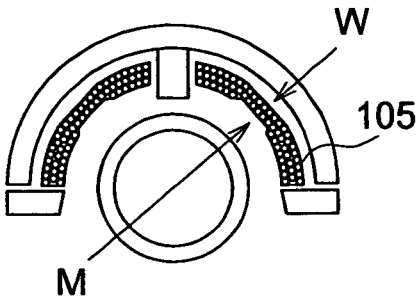
Figure 9D:
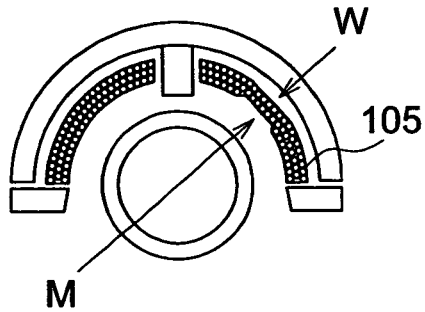
Figure 9E:
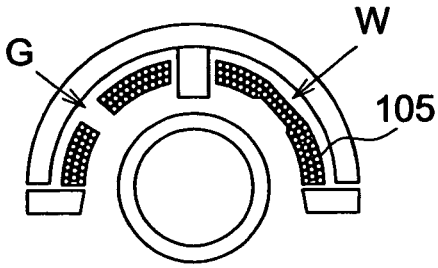
Figure 9F:
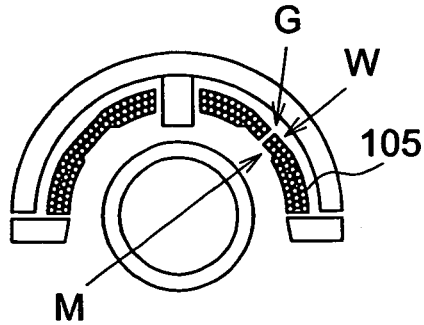
Figure 10A:
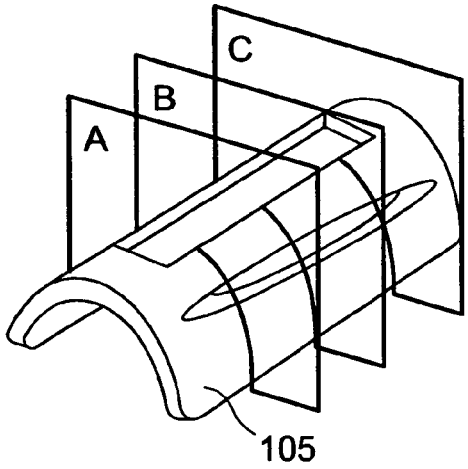
FIG. 10 shows a modified example of the coil cross-section shape related to the first embodiment of the present invention.
Figure 10B:
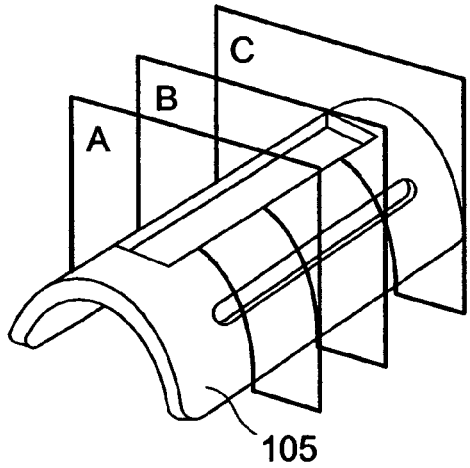
Figure 10C:
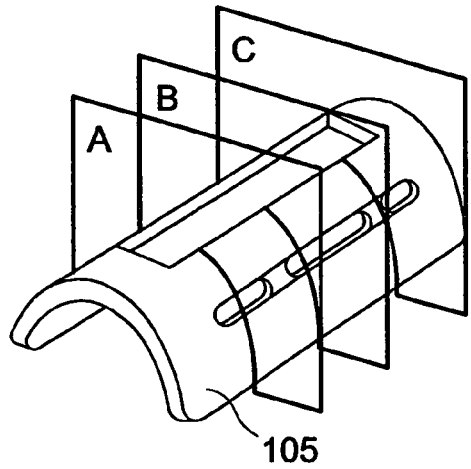
Figure 11A:
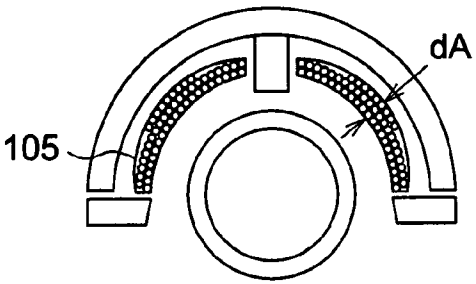
FIG. 11(*a*) is a cross-section of plane A of (d)
Figure 11B:
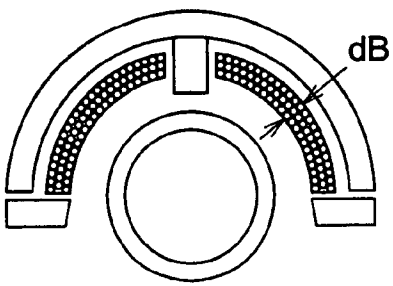
Figure 11C:
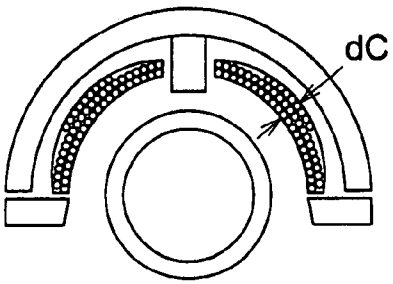
Figure 11D:
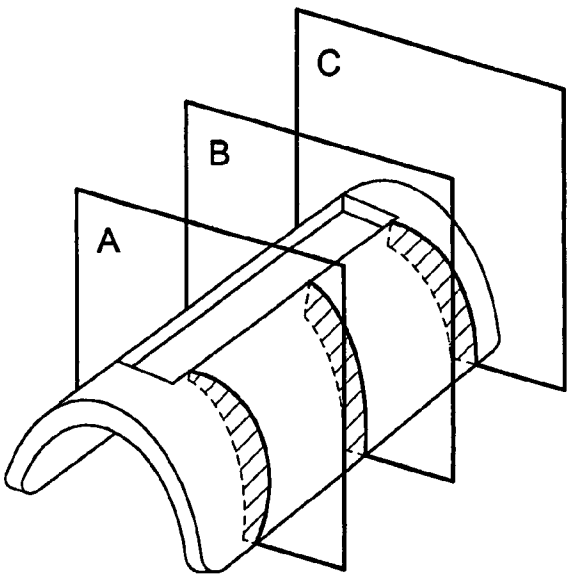
Figure 12:
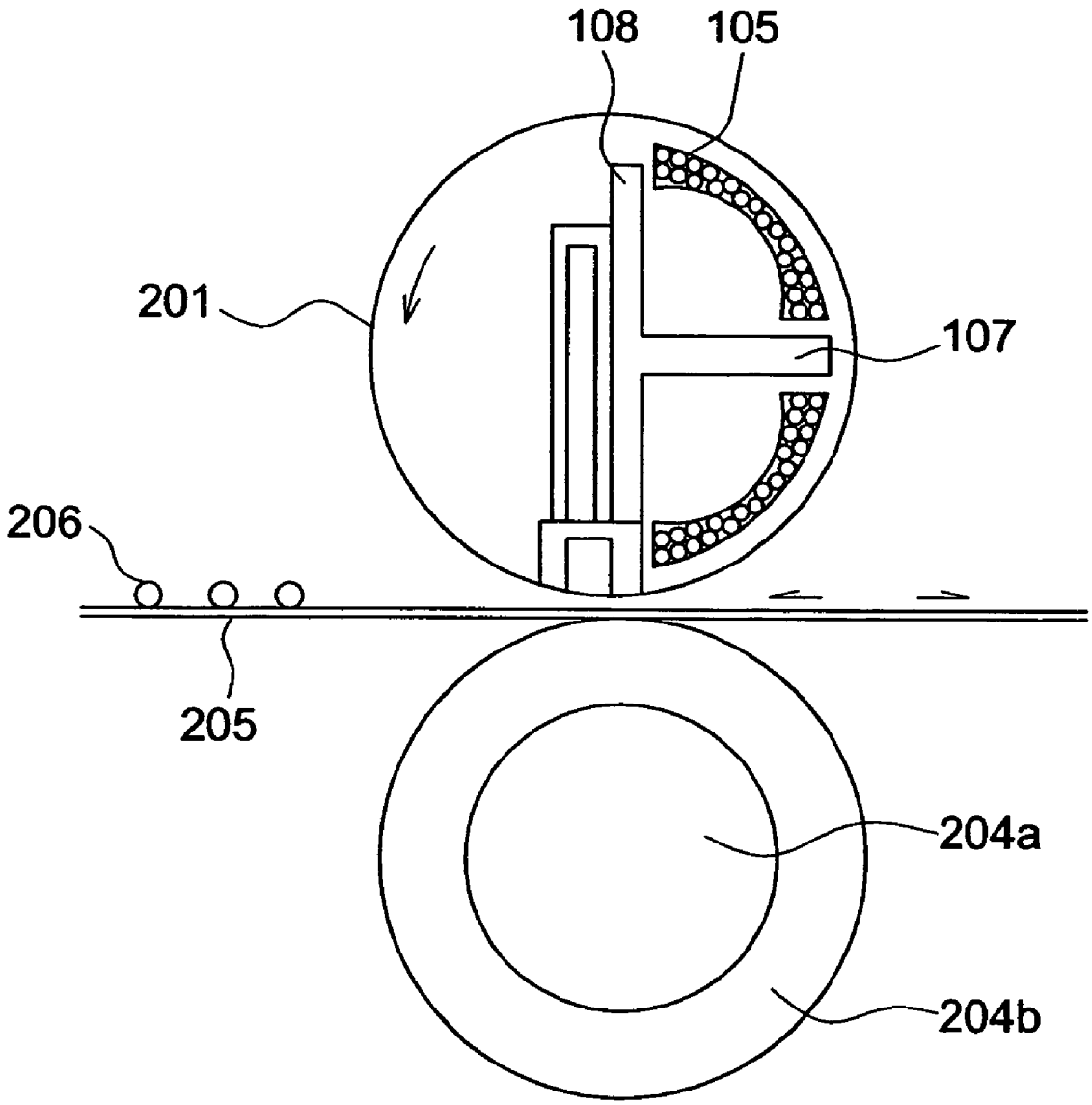
FIG. 12 is a schematic view showing another composition related to the first embodiment of the present invention.

FIG. 7 is a perspective view showing a magnetic excitation coil of an induction heater related to the second embodiment of the present invention. FIG. 8(*a*) is a cross-section of plane A of the magnetic excitation coil of FIG. 5 related to the second embodiment of the present invention, FIG. 8(*b*) is a cross-section of plane B of the magnetic excitation coil of FIG. 5 related to the second embodiment of the present invention, and FIG. 8(*c*) is a cross-section of plane C of the magnetic excitation coil of FIG. 5 related to the second embodiment of the present invention. FIG. 9 shows a modified example of a coil shape related to the second embodiment of the present invention. FIG. 10 shows a modified example of the coil cross-section shape related to the first embodiment of the present invention. FIG. 11(*a*) is a cross-section of plane A of (d), FIG. 11(*b*) is a cross-section of plane B of (d), FIG. 11(*c*) is a cross-section of plane C of (d), and FIG. 11(*d*) is a modified example of another cross-section shape related to the first embodiment of the present invention. FIG. 12 is a schematic view showing another composition related to the first embodiment of the present invention.

As shown in FIG. 7, the magnetic excitation coil 105 is comprised so as to change a space (i.e., a hole) in a direction parallel to the axis of rotation of the heating roller 201.

Here, as shown in FIG. 8(*a*), (*b*), and (*c*), the width of the space S of the magnetic excitation coil 105 can be comprised such that it becomes smaller from the center towards the end. In other words, if the width of the space of the magnetic excitation coil at the center is SB, the width of the space of the magnetic excitation coil at the end is SA, SC, a relationship of SB>SA, SB>SC will be established. The space of the magnetic excitation coil at both ends is eliminated.

In this manner, the heat generation temperature of the magnetic field at the end becomes larger compared to the heat generation temperature at the center. The heat generation temperature at the end can be increased and the temperature distribution in the fixing nip assembly N can be made uniform.

In each embodiment related to the present invention, the magnetic excitation coil cross-sectional shape is not limited to the example disclosed above but can be modified in a different way as shown in FIG. 9.

The cross-sectional shape of the magnetic excitation coil 105 graphically represents a concave portion (i.e., a recess) on the heat generator side and FIG. 9(*a*) shows a composition that provides a concave portion on the outside of the magnetic excitation coil. According to this composition, the heat generator of the concave portion W and the distance of the coil center of gravity can change the magnetic field without being moving apart. FIG. 9(*b*) shows a composition that provides concave portions on both sides, a concave portion M on the inside of the magnetic excitation coil and an outside concave portion W. According to this composition, the amount of depth of the inside concave portion M and the amount of depth of the outside concave portion W can be reduced making it possible to form a curved surface that changes smoothly. FIG. 9(*c*) shows a composition in which the shape of the concave portion is not a circular arc but an approximate straight line. According to this composition, a magnetic field can be created that gently changes the magnetic field generated from the magnetic excitation coil 105. In these examples, although the cross section of the magnetic excitation coil 105 shows a composition with left and right symmetry, as shown in FIG. 9(*d*), the magnetic excitation coil 105 does not always need left and right symmetry and looking at the heat generation amount of the heat generator, the shape of the cross section of only one side is also changed to adjust the heat generation amount.

As shown in FIG. 9(*e*), the composition can also combine space G and concave portion M, and concave portion W.

Furthermore, as shown in FIG. 9(*f*), the composition can also arrange space G in concave portion M, concave portion W or both.

The magnetic excitation coil 105 of FIG. 10(*a*) shows a composition that changes the space to an elliptical shape from the center extending to the end. According to this composition, the temperature distribution of the heat generator that changes the temperature distribution can be adjusted the more movement is from the center to the end. The magnetic excitation coil 105 of FIG. 10(*b*) provides approximately parallel spaces from the center to the end and shows a composition that only eliminated spaces on both sides. According to this composition, it is possible to improve temperature reductions due to heat radiation at both ends of the heat generator, increase the heat generation amount at the end, and make the temperature distribution in the fixing nip assembly N uniform.

The magnetic excitation coil 105 of FIG. 10(*c*) shows a composition that eliminates spaces at one part from the end extending to the center. According to this composition, the heat generation distribution can be finely adjust in response to the heat generation state of the fixing state making it possible to adjust the uniformity of the temperature distribution in the entire lengthwise direction and configure a fixing device with high image quality.

Although the composition in the embodiment described above made the thickness of the center in the lengthwise direction thinner with respect to the end as a way to provide a difference in the thickness of the magnetic excitation coil at the center in the lengthwise direction and the end, the composition can also make the thickness at the center of the coil winding width thicker as shown in FIG. 1(*a*). According to this composition, because the thickness at the center of the coil winding of the cross-section at the end becomes thicker compared to the cross-section of the center shown in FIG. 11 (*b*), the heat generation amount at the end can be increased in addition to the embodiment described above.

The construction also had a temperature gradient occurring at the left and right of the fixing device due to the airflow inside the image forming apparatus and a difference in the coil thickness of the cross section at the left and right.

Furthermore, the heating apparatuses related to each of the embodiments describe above have compositions in which the magnetic excitation coil 105 and the arch core 106, and the center core 107 and the side core 108 are arranged opposite each other along the outer peripheral surface of the heat generation belt 203 that includes a body of rotation. Because the heat generation belt 203 and the heating roller 201 in the heating apparatus of this composition can be arranged separately from the magnetic excitation coil 105 and the arch core 106, the maintenance of the apparatus can also be simplified. Even further, because these is no need to exchange the magnetic excitation coil 105 and the arch core 106, or the center core 107 and the side core 108, there is an advantage of saving resources.

When it is necessary to place importance on making the entire apparatus more compact without considering the maintenance of the apparatus as described above, the magnetic excitation coil 105, the arch core 106, the center core 107, and the side core 108 can be arranged inside the heat generation belt 203 that is the body of rotation.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2004-076235 filed on Mar. 17, 2004 entire content of which is expressly incorporated by reference herein.

What is claimed is:

1. A heating apparatus for an electromagnetic induction heating system, comprising:

a heat roller that comprises magnetic and conductive material; and a magnetic excitation coil configured to be positioned around an outermost portion of an external periphery of the heat roller, the magnetic excitation coil being configured to generate a magnetic field that extends to the heat roller, to generate an eddy current within the heat roller, and to generate Joule heat within the heat roller, the magnetic excitation coil being further configured to generate a smaller magnetic field at the center area of the heat roller than at the side areas of the heat roller, wherein a thickness of the magnetic excitation coil, measured within an angle of between about 30°–60° with respect to a lower edge of the magnetic excitation coil at the side areas of the heat roller is greater than a thickness of the magnetic excitation coil measured within an angle of between about 30°–60° with respect to a lower edge of the magnetic excitation coil at the center area of the heat roller.

2. The heating apparatus according to claim 1, wherein the magnetic excitation coil comprises a plurality of wires, a diameter of each wire being about 0.05 mm to 0.2 mm, a thickness of the excitation coil being below about 2 mm.

3. The heating apparatus according to claim 1, further comprising a core, the core guiding magnetic flux generated by the magnetic excitation coil, the core comprising one of a arch core, a center core, and a side core, the arch core comprising a magnetic material and covering a surface of the magnetic excitation coil, the center core comprising a magnetic material and being provided within the magnetic excitation coil, the side core comprising a magnetic material and being provided outside the magnetic excitation coil.

4. The heating apparatus according to claim 1, wherein an insulator is provided between the heat roller and the magnetic excitation coil.

5. The heating apparatus according to claim 1, further comprising a coil holding member to which the magnetic excitation coil is mounted, the coil holding member, at the center area of the heat roller comprises one of a hole and a recess with a shape that gradually varies along a length of the coil holding member.

6. The heating apparatus according to claim 5, wherein one of the hole and the recess is provided on the magnetic excitation coil at an angle of between 30°–60° with respect to a low edge of the magnetic excitation coil.

7. The heating apparatus according to claim 5, wherein the shape changes gradually as the one of hole and recess extends from the center towards the ends of the heat roller.

8. The heating apparatus according to claim 1, further comprising a magnetic core within the heat roller, wherein the magnetic excitation coil configures a magnetic path with the magnetic core through the heat roller.

9. The heating apparatus according to claim 1, a surface of the magnetic excitation coil facing the external periphery of the heat roller having an arched shape corresponding to an external peripheral shape of the heat roller.

10. The heating apparatus according to claim 1, further comprising an arched core provided externally of the magnetic excitation coil and extending about an external periphery of the magnetic excitation coil, a center core externally positioned at a center and extending along a length of said magnetic excitation coil and side cores externally positioned at ends of the magnetic excitation coil.

11. The heating apparatus according to claim 1, wherein the thickness of the magnetic excitation coil at the center area of the heat roller varies gradually from a thickness substantially equal to the thickness of the magnetic excitation coil at the side areas of the heat roller to a thickness substantially less than the thickness of the magnetic excitation coil at the side areas of the heat roller.

12. A fusing apparatus for an electromagnetic induction heating system, comprising:

a heat roller that comprises magnetic and conductive material; and a magnetic excitation coil configured to be positioned around an outermost portion of an external periphery of the heat roller, the magnetic excitation coil being configured to generate a magnetic field that extends to the heat roller, to generate an eddy current within the heat roller, and to generate Joule heat within the heat roller;

a fusing roller configured to fuse a toner image on a recording medium;

a pressure roller configured to press the recording medium to the fusing roller; and a belt configured to conduct the generated heat from the heat roller to the fusing roller, the magnetic excitation coil being further configured to generate a smaller magnetic field at a center area of the heat roller than at side areas of the heat roller, wherein the magnetic excitation coil comprises a plurality of circumferentially spaced coil sections, a spacing between adjacent coil sections at the ends of the heat roller being less than a spacing between adjacent coil sections at the center of the heat roller.

13. A image forming apparatus provided with the fusing apparatus according to claim 12.

14. The fusing apparatus according to claim 12, wherein a holder that carries the magnetic excitation coil, at a center area comprises one of a hole and a recess that undergoes a gradual change in shape as the one of the hole and recess extends from the center area towards end areas of the heat roller.

15. The fusing apparatus according to claim 12, a surface of the magnetic excitation coil facing the external periphery of the heat roller having an arched shape corresponding to an external peripheral shape of the heat roller.

16. The fusing apparatus according to claim 12, wherein the spacing comprises at least one longitudinally extending area free from windings that make up the magnetic excitation coil, the longitudinally extending area free from windings having a greater circumferential extent at the center area of the heat roller than at the ends of the heat roller.

17. The fusing apparatus according to claim 12, the spacing between coil sections being circumferentially displaced from a central portion of a core that guides the magnetic flux generated by the magnetic excitation coil, the central portion of the core projecting through an opening in the magnetic excitation coil.

* * * * *